US008845821B2

(12) United States Patent
Odaka et al.

(10) Patent No.: US 8,845,821 B2
(45) Date of Patent: Sep. 30, 2014

(54) PROCESS FOR PRODUCTION OF R-FE-B-BASED RARE EARTH SINTERED MAGNET, AND STEAM CONTROL MEMBER

(75) Inventors: Tomoori Odaka, Osaka (JP); Hideyuki Morimoto, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 309 days.

(21) Appl. No.: 13/382,755

(22) PCT Filed: Jul. 8, 2010

(86) PCT No.: PCT/JP2010/061629

§ 371 (c)(1),
(2), (4) Date: Jan. 6, 2012

(87) PCT Pub. No.: WO2011/004867

PCT Pub. Date: Jan. 13, 2011

(65) Prior Publication Data

US 2012/0114844 A1 May 10, 2012

(30) Foreign Application Priority Data

Jul. 10, 2009 (JP) ..... 2009-163302

(51) Int. Cl.

| | |
|---|---|
| ***B05D 5/12*** | (2006.01) |
| ***C22C 38/00*** | (2006.01) |
| ***H01F 1/057*** | (2006.01) |
| ***B22F 3/24*** | (2006.01) |
| ***C22C 38/06*** | (2006.01) |
| ***C22C 38/16*** | (2006.01) |
| ***C22C 38/10*** | (2006.01) |
| ***C22C 33/02*** | (2006.01) |
| ***H01F 41/02*** | (2006.01) |

(52) U.S. Cl.

CPC ..... *H01F 1/0577* (2013.01); *C22C 38/005* (2013.01); *B22F 3/24* (2013.01); *B22F 2999/00* (2013.01); *C22C 38/06* (2013.01); *C22C 38/16* (2013.01); *C22C 38/10* (2013.01); *C22C 38/002* (2013.01); *C22C 33/0278* (2013.01); *H01F 41/0293* (2013.01)

USPC ..... 148/101; 427/127

(58) Field of Classification Search

CPC ... B05D 5/12; B22F 2999/00; C22C 33/0278; C22C 38/002

USPC ..... 148/101; 427/127

See application file for complete search history.

(56) References Cited

U.S. PATENT DOCUMENTS 5,104,695 A * 4/1992 Greer et al. ..... 427/250
5,383,978 A 1/1995 Yamamoto et al.

(Continued)

FOREIGN PATENT DOCUMENTS

JP 54-90216 A 7/1979
JP 62-192566 A 8/1987

(Continued)

OTHER PUBLICATIONS

English translation of Official Communication issued in corresponding International Patent Application No. PCT/JP2010/061629, mailed on Feb. 16, 2012.

*Primary Examiner* — Jei Yang

(74) *Attorney, Agent, or Firm* — Keating & Bennett, LLP

(57) ABSTRACT

A sintered R—Fe—B based rare-earth magnet body 1 including, as a main phase, crystal grains of an $R_2Fe_{14}B$ type compound that includes a light rare-earth element RL, which is Nd and/or Pr, as a major rare-earth element R is provided. A bulk body 2 including a heavy rare-earth element RH, which is at least one of Dy, Ho and Tb is also provided. The sintered magnet body 1 and the bulk body 2 are arranged in a processing chamber 4 with a vapor control member 3 interposed between the sintered magnet body 1 and the bulk body 2. And the inside of the processing chamber 4 is heated to a temperature of 700° C. to 1000° C., thereby diffusing the heavy rare-earth element RH inside the sintered magnet body 1 while supplying the heavy rare-earth element RH from the bulk body 2 to the surface of the sintered magnet body 1 via the vapor control member 3.

8 Claims, 8 Drawing Sheets

(56) References Cited

U.S. PATENT DOCUMENTS

| | | | | |
|---|---|---|---|---|
| 7,402,226 | B2 | 7/2008 | Machida et al. | |
| 8,206,516 | B2 * | 6/2012 | Yoshimura et al. | 148/122 |
| 8,268,078 | B2 * | 9/2012 | Suzuki et al. | 118/715 |
| 2008/0286595 | A1 | 11/2008 | Yoshimura et al. | |
| 2009/0138070 | A1 * | 5/2009 | Holzer et al. | 623/1.15 |
| 2010/0037826 | A1 | 2/2010 | Nagata et al. | |
| 2010/0239878 | A1 | 9/2010 | Nagata et al. | |
| 2011/0273252 | A1 * | 11/2011 | Kikugawa et al. | 335/302 |

FOREIGN PATENT DOCUMENTS

| | | | |
|---|---|---|---|
| JP | 2004-296973 | A | 10/2004 |
| JP | 2004-304038 | A | 10/2004 |
| JP | 2005-285859 | A | 10/2005 |
| JP | 2009-88191 | A | 4/2009 |
| WO | 2007/102391 | A1 | 9/2007 |
| WO | 2009/057592 | A1 | 5/2009 |
| WO | 2009/107397 | A1 | 9/2009 |

* cited by examiner (a)

(b)

(c)

T1=T2=1. 1mm

T1=T2=0. 45mm

T1=T2=0. 3mm

PROCESS FOR PRODUCTION OF R-FE-B-BASED RARE EARTH SINTERED MAGNET, AND STEAM CONTROL MEMBER

TECHNICAL FIELD

The present invention relates to a method for producing a sintered R—Fe—B based rare-earth magnet including crystal grains of an $R_2Fe_{14}B$ type compound (where R is a rare-earth element) as a main phase. More particularly, the present invention relates to a method for producing a sintered R—Fe—B based rare-earth magnet, which includes a light rare-earth element RL (which is at least one of Nd and Pr) as a major rare-earth element R and in which a portion of the light rare-earth element RL is replaced with a heavy rare-earth element RH (which is at least one element selected from the group consisting of Dy, Ho and Tb).

This invention also relates to a vapor control member that can be used effectively in the manufacturing process of a sintered R—Fe—B based rare-earth magnet.

BACKGROUND ART

A sintered R—Fe—B based rare-earth magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. When used in motors and various other devices, the sintered R—Fe—B based rare-earth magnet should exhibit thermal resistance and coercivity that are high enough to withstand an operating environment at an elevated temperature.

As a means for increasing the coercivity of a sintered R—Fe—B based rare-earth magnet, a molten alloy, including a heavy rare-earth element RH as an additional element, may be used. According to this method, the light rare-earth element RL, which is included in an $R_2Fe_{14}B$ phase, is replaced with a heavy rare-earth element RH, and therefore, the magnetocrystalline anisotropy (which is a decisive quality parameter that determines the coercivity) of the $R_2Fe_{14}B$ phase improves. However, the remanence $B_r$ would decrease in proportion to the percentage of the light rare-earth element RL replaced with the heavy rare-earth element RH.

Meanwhile, as the heavy rare-earth element RH is one of rare natural resources, its use is preferably cut down as much as possible. For these reasons, the method in which a portion of the light rare-earth element RL is simply replaced with the heavy rare-earth element RH is not preferred.

To get the coercivity increased effectively with the addition of a relatively small amount of the heavy rare-earth element RH, it was proposed that an alloy or compound powder, including a lot of the heavy rare-earth element RH, be added to a main phase material alloy powder including a lot of the light rare-earth element RL and then the mixture be compacted and sintered. According to this method, the heavy rare-earth element RH is distributed a lot in the vicinity of the grain boundary of the $R_2Fe_{14}B$ phase, and therefore, the magnetocrystalline anisotropy of the $R_2Fe_{14}B$ phase can be improved efficiently in the outer periphery of the main phase. The sintered R—Fe—B based rare-earth magnet has a nucleation-type coercivity generating mechanism. That is why if a lot of the heavy rare-earth element RH is distributed in the outer periphery of the main phase (i.e., near the grain boundary thereof), the magnetocrystalline anisotropy of all crystal grains is improved, the nucleation of reverse magnetic domains can be interfered with, and the coercivity increases as a result. At the core of the crystal grains, no light rare-earth element RL is replaced with the heavy rare-earth element RH. Consequently, the decrease in remanence $B_r$ can be minimized there, too.

If this method were actually adopted, however, the heavy rare-earth element RH could not always have such a high concentration around the outer periphery of the main phase. For that reason, it is not easy to obtain the expected crystal structure.

As another method for increasing the coercivity of a sintered R—Fe—B based rare-earth magnet, a metal, an alloy or a compound including a heavy rare-earth element RH is deposited on the surface of the sintered magnet and then thermally treated and diffused. Then, the coercivity could be recovered or increased without decreasing the remanence so much (see Patent Documents Nos. 1, 2 and 3).

Patent Document No. 1 teaches forming a thin-film alloy layer, 1.0 at % to 50.0 at % of which is accounted for by at least one of Ti, W, Pt, Au, Cr, Ni, Cu, Co, Al, Ta and Ag and the balance of which is R' that is at least one element selected from the group consisting of Ce, La, Nd, Pr, Dy, Ho, and Tb, on the surface of a sintered magnet body to be machined.

Patent Document No. 2 discloses that a metallic element R (which is one or two rare-earth elements selected from the group consisting of Y, Nd, Dy, Pr, Ho, and Tb) is diffused to a depth that is at least equal to the radius of crystal grains exposed on the uppermost surface of a small-sized magnet, thereby repairing the damage done on the machined surface and increasing $(BH)_{max}$.

Patent Document No. 3 discloses that by depositing a CVD film, consisting mostly of a rare-earth element, on the surface of a magnet with a thickness of 2 mm or less, the magnetic properties could be recovered.

Patent Document No. 4 discloses a method of sorbing a rare-earth element to recover or increase the coercivity of a very small sintered R—Fe—B based magnet or its powder. According to the method of Patent Document No. 4, a sorption metal, which is a rare-earth metal such as Yb, Eu or Sm with a relatively low boiling point and a very small sintered R—Fe—B based magnet or its powder are mixed together, and then the mixture is subjected to a heat treatment to heat it uniformly in a vacuum while stirring it up. As a result of this heat treatment, the rare-earth metal is not only deposited on the surface of the magnet but also diffused inward. Patent Document No. 4 also discloses an embodiment in which a rare-earth metal with a high boiling point such as Dy is sorbed. In such an embodiment that uses Dy, for example, Dy is selectively heated to a high temperature by induction heating. According to Patent Document No. 4, Dy could not be heated sufficiently by normal resistance heating process. Patent Document No. 4 also states that the temperature of the very small sintered R—Fe—B based magnet and its powder is preferably kept within the range of 700° C. to 850° C.

Patent Document No. 5 discloses an evaporation diffusion process, which is a technique for supplying Dy that has sublimed from a plate of Dy (which is called a "Dy bulk body") to a sintered magnet body that faces the Dy bulk body while at the same time diffusing Dy inside of the magnet body through the grain boundary of the sintered magnet body.

CITATION LIST

Patent Literature

Patent Document No. 1: Japanese Patent Application Laid-Open Publication No. 62-192566

Patent Document No. 2: Japanese Patent Application Laid-Open Publication No. 2004-304038

Patent Document No. 3: Japanese Patent Application Laid-Open Publication No. 2005-285859

Patent Document No. 4: Japanese Patent Application Laid-Open Publication No. 2004-296973

Patent Document No. 5: PCT International Application Publication No. 2007/102391

SUMMARY OF INVENTION

Technical Problem

All of the techniques disclosed in Patent Documents Nos. 1, 2 and 3 were developed to repair the damage done on the machined surface of a sintered magnet. That is why the metallic element, diffused inward from the surface, can reach no farther than a surface region of the sintered magnet. For that reason, if the magnet had a thickness of 3 mm or more, the coercivity could hardly be increased effectively. Also, if those techniques are applied to increasing the coercivity, a similar problem will arise as in Patent Document No. 4 as will be described later.

Meanwhile, according to the conventional technique disclosed in Patent Document No. 4, a rare-earth metal such as Dy is heated to, and deposited at, a temperature that is high enough to vaporize it easily. That is why a thick Dy film is deposited on the surface of the magnet. As a result, in the surface region of the magnet (with a depth of up to several tens of μm as measured from the surface), a big difference in Dy concentration at the interface between the Dy film deposited and the sintered magnet body should inevitably generate a driving force to diffuse Dy into the main phase as well. Consequently, the remanence $B_r$ drops extensively in that region near the surface.

On top of that, according to the method of Patent Document No. 4, the rare-earth metal is also deposited a lot on unexpected portions of the deposition system (e.g., on the inner walls of the vacuum chamber) other than the magnet during the deposition process, which is against the policy of saving a heavy rare-earth element that is one of rare and valuable natural resources.

Furthermore, according to the embodiment that uses a rare-earth metal with a low boiling point such as Yb, the coercivity of each very small sintered R—Fe—B based magnet can be recovered to a certain degree. But it is difficult to prevent the sorption metal from melting and sticking to the R—Fe—B based magnet during the heat treatment process for diffusion or to separate them from each other after the heat treatment process. That is to say, it is virtually inevitable that unreacted sorption metal (RH) remains on the surface of the sintered magnet, which would decrease the percentage of magnetic components in the magnet compact (i.e., deteriorate the magnetic properties thereof). In addition, since a rare-earth metal is very active and easily oxidizable by nature, that unreacted sorption metal should often start corrosion in practical use, which is not beneficial. Besides, since the mixture needs to be rotated to be stirred up and subjected to the heat treatment in a vacuum at the same time, a special type of equipment that can maintain a predetermined thermal resistance and a prescribed pressure (or airtightness) and also includes a rotation mechanism would be required. That is why the initial equipment cost, product quality and stability of production would all be problems to realize mass production. What is more, if a powder were used as the material of the sorption metal, some safety precautions should be taken so as not to fire the powder or do any harm on human bodies and it would take a lot of trouble and increased cost to prepare the powder in the first place.

Furthermore, according to the embodiment that uses a rare-earth metal with a high boiling point such as Dy, the sorption material and the magnet are both heated to mutually different predetermined temperatures by an induction heating process. That is why it is not easy to heat only the rare-earth metal to a sufficiently high temperature and yet maintain it at a temperature that is low enough to avoid affecting the magnetic properties. As a result, the magnet will often have a powder state or a very small size and is not easily subjected to the induction heating process in either case.

Patent Document No. 5 does disclose a technique for overcoming these problems with Patent Documents Nos. 1 to 4 by using an Nb net as a means for holding the sintered magnet body during the evaporation diffusion process. However, when used at high temperatures for long hours, the Nb net may be deformed. In addition, the heavy rare-earth element cannot be supplied or diffused uniformly in a region in contact with the held portions.

It is therefore an object of the present invention to provide a method for producing a sintered R—Fe—B based rare-earth magnet that can diffuse a small amount of heavy rare-earth element RH uniformly through the entire surface of a sintered magnet body by utilizing that heavy rare-earth element RH as efficiently as possible.

Solution to Problem

A method for producing a sintered R—Fe—B based rare-earth magnet according to the present invention includes the steps of: providing a sintered R—Fe—B based rare-earth magnet body including, as a main phase, crystal grains of an $R_2Fe_{14}B$ type compound that includes a light rare-earth element RL, which is at least one of Nd and Pr, as a major rare-earth element R; providing a bulk body including a heavy rare-earth element RH, which is at least one element selected from the group consisting of Dy, Ho and Tb; arranging the sintered R—Fe—B based rare-earth magnet body and the bulk body in a processing chamber with a vapor control member interposed between the sintered R—Fe—B based rare-earth magnet body and the bulk body; and heating the inside of the processing chamber to a temperature of 700° C. to 1000° C., thereby diffusing the heavy rare-earth element RH inside the sintered R—Fe—B based rare-earth magnet body while supplying the heavy rare-earth element RH from the bulk body to the surface of the sintered R—Fe—B based rare-earth magnet body via the vapor control member. The vapor control member includes: an upper surface and a lower surface; a plurality of openings, which communicate between the upper and lower surfaces; and a wall portion, which defines the openings. If the wall portion has a thickness of 0.5 mm or less, and if each of the openings of the vapor control member has a depth of 1 mm to 10 mm, and if each of the openings of the vapor control member has an area of A [$mm^2$] and a depth of D [mm], then D/A is equal to or smaller than 8 $mm^{-1}$.

In one preferred embodiment, the method includes the step of supporting the sintered R—Fe—B based rare-earth magnet body on the upper surface of the vapor control member and supplying the heavy rare-earth element RH from the bulk body, which is arranged to face the lower surface of the vapor control member, to the surface of sintered R—Fe—B based rare-earth magnet body.

In another preferred embodiment, a portion of the vapor control member that contacts with the sintered R—Fe—B based rare-earth magnet body is coated with an anti-sticking film.

In still another preferred embodiment, the vapor control member is made of a ceramic material.

In yet another preferred embodiment, the vapor control member has a flat end facet on the upper and lower surfaces.

In yet another preferred embodiment, each of the openings of the vapor control member is defined as a cuboid space, of which four faces are surrounded with the wall portion.

In yet another preferred embodiment, the openings of the vapor control member are arranged so as to form a honeycomb structure.

Advantageous Effects of Invention

According to the present invention, a small amount of heavy rare-earth element RH can diffuse uniformly through the entire surface of a magnet body by utilizing that heavy rare-earth element RH as efficiently as possible.

In addition, the vapor control member for use in the present invention has a thermal resistance that is too high to be deformed easily, and therefore, can be used repeatedly a number of times, thus contributing to cutting down the manufacturing cost and increasing the yield. On top of that, this vapor control member does not stick to the sintered magnet body easily. That is why even when the sintered magnet body needs to be released from the vapor control member after the evaporation diffusion process, it is possible to prevent any part of the sintered magnet body from chipping or collapsing.

DESCRIPTION OF EMBODIMENTS

Hereinafter, a process for producing a sintered R—Fe—B based rare-earth magnet according to the present invention will be described with reference to FIG. 1.

According to the present invention, first of all, a sintered R—Fe—B based rare-earth magnet body 1 and a bulk body 2 including a heavy rare-earth element RH are provided. The sintered R—Fe—B based rare-earth magnet body 1 includes, as a main phase, crystal grains of an $R_2Fe_{14}B$ type compound that includes a light rare-earth element RL, which is at least one of Nd and Pr, as a major rare-earth element R. On the other hand, the bulk body 2 includes a heavy rare-earth element RH, which is at least one element selected from the group consisting of Dy, Ho and Tb. The bulk body 2 is typically a metal consisting essentially of the heavy rare-earth element RH. In this description, the sintered R—Fe—B based rare-earth magnet body 1 will sometimes be simply referred to herein as a "sintered magnet body 1" and the bulk body 2 will sometimes be referred to herein as an "RH bulk body 2".

Figure 1:
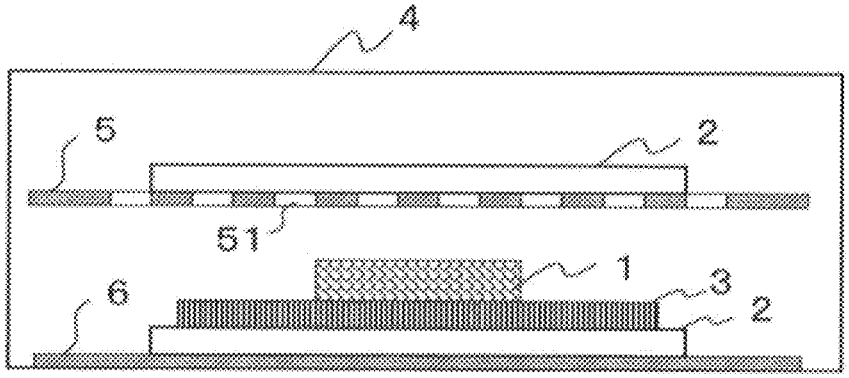
FIG. 1 illustrates a manufacturing process step to produce a sintered R—Fe—B based rare-earth magnet according to the present invention.

Next, as shown in FIG. 1, the sintered magnet body 1 and the RH bulk body 2 are both arranged in a processing chamber 4 with a vapor control member 3 interposed between the sintered magnet body 1 and the RH bulk body 2. In the example illustrated in FIG. 1, one RH bulk body 2 is arranged under the sintered magnet body 1 and another RH bulk body 2 is arranged over the sintered magnet body 1. The vapor control member 3 is inserted between the lower RH bulk body 2 and the sintered magnet body 1. On the other hand, the upper RH bulk body 2 is supported on a plate 5 of a refractory metal. This plate 5 is a metallic plate of Mo, for example, and has openings 51. The plate 5 of the refractory metal is held by another member (not shown).

The lower RH bulk body 2 is put on a tray 6 of a refractory metal so as to avoid contacting with the processing chamber 4 directly. The tray 6 of the refractory metal, as well as the plate 5 of the refractory metal, is made of a refractory metal such as Mo.

Figure 2:
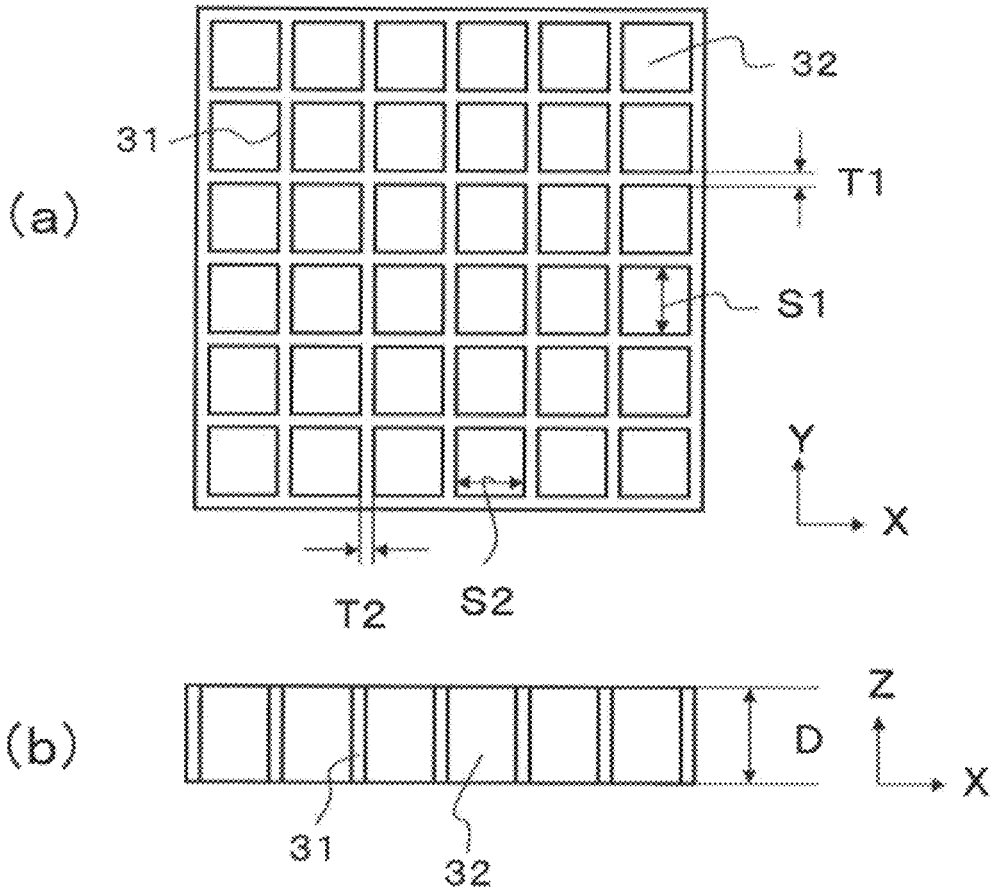
FIGS. 2(*a*) and 2(*b*) are respectively a plan view and a cross-sectional view illustrating a vapor control member according to the present invention.

The vapor control member 3 may have the structure shown in FIGS. 2(*a*) and 2(*b*), for example. FIG. 2(*a*) is a top view of the vapor control member 3 and FIG. 2(*b*) is a cross-sectional view thereof. Hereinafter, the structure of the vapor control member 3 will be described.

As shown in FIG. 2(*a*), the vapor control member 3 is designed so that a wall portion 31 with thicknesses T1 and T2 surrounds a number of openings 32. In the example illustrated in FIG. 2, the wall portion 31 has a grating structure, in which a number of openings 32 are arranged in X and Y directions. In this case, the portion 31 has a thickness T1 as measured in the Y direction and has a thickness T2 as measured in the X direction, the size of the openings 32 as measured in the Y direction (which will be sometimes referred to herein as its "inner size") is S1, and the size of the openings 32 as measured in the X direction is S2. T1=T2 and S1=S2 are typically satisfied but do not always have to be satisfied. The depth D of the openings 32 is equal to the height of the wall portion 31 (i.e., its size as measured in the Z direction) as shown in FIG. 2(*b*). The vapor control member 3 is arranged inside of the processing chamber 4 and heated to a high temperature, and therefore, needs to have high thermal resistance. In addition, as the vapor control member 3 contacts with the sintered magnet body 1 at a high temperature, the vapor control member 3 is preferably made of a stabilized material that does not easily react with elements included in the sintered magnet body 1.

In the example illustrated in FIG. 2, the openings 32 are cuboids. However, the present invention can also be carried out even if the openings have a hexagonal prism shape or a triangular prism shape.

It will be described later how the vapor control member 3 works.

Now take a look at FIG. 1 again. As shown in FIG. 1, after the sintered magnet body 1, the RH bulk bodies 2 and the vapor control member 3 have been arranged in the processing chamber 4, the inside of the processing chamber 4 is heated by a heater (not shown) to a temperature of 700° C. to 1000° C. As a result of this heating process, the temperatures of the sintered magnet body 1 and the RH bulk bodies 2 are raised to the range of 700° C. to 1000° C. Consequently, atoms that have vaporized from the RH bulk bodies 2 are supplied onto the surface of the sintered magnet body 1 via the vapor control member 3. In the arrangement illustrated in FIG. 1, the heavy rare-earth element RH is supplied from the upper RH bulk body 2 onto the surface of the sintered magnet body 1 through the openings 51 of the refractory metal plate 5 and then diffuses inside the sintered magnet body 1.

According to the manufacturing process of the present invention, the RH bulk bodies 2 and the sintered magnet body 1 are heated to a temperature of 700° C. to 1000° C., thereby vaporizing (i.e., subliming) the RH bulk bodies 2 and thermally diffusing the heavy rare-earth element RH, which has traveled through the inner space of the processing chamber to reach the surface of the sintered magnet body 1, inside the sintered magnet body. By setting the temperature within that range of 700° C. to 1000° C., an appropriate amount of the RH bulk bodies can sublime and the heavy rare-earth element RH that has been supplied onto the surface of the sintered magnet body can make a grain boundary diffusion quickly inside of the sintered magnet body substantially without being deposited on the surface.

According to the present invention, the vapor control member 3 with the structure shown in FIG. 2 is arranged between the sintered magnet body 1 and the lower RH bulk body 2 as shown in FIG. 1. This vapor control member 3 performs the functions of not only supporting the sintered magnet body 1 on its upper surface but also supplying the heavy rare-earth element RH, which has sublimed from the RH bulk body 2 arranged under itself, to the sintered magnet body 1 uniformly.

Figure 3:
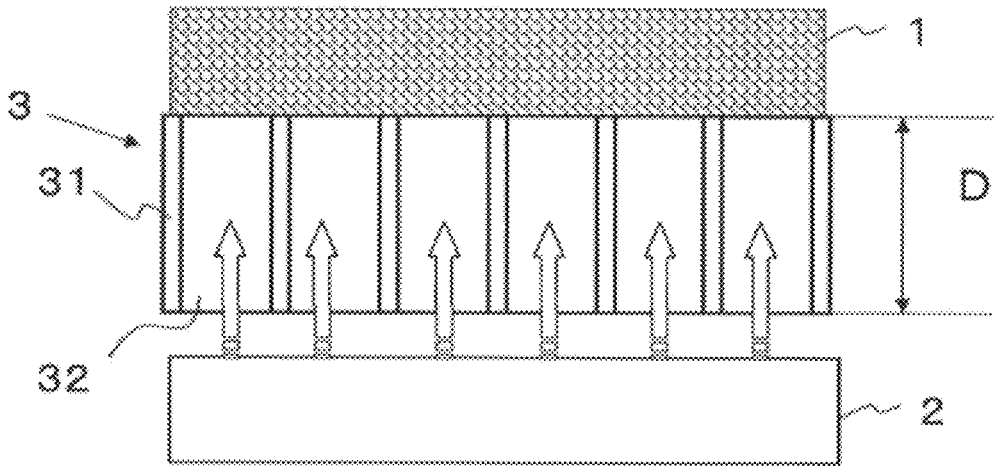
FIG. 3 is a cross-sectional view illustrating how the vapor control member works.

FIG. 3 is a cross-sectional view schematically illustrating how the vapor control member 3 supplies the heavy rare-earth element RH that has sublimed from the RH bulk body 2 that is arranged under itself to the sintered magnet body 1. The vapor control member 3 does not have to contact with the RH bulk body 2. But the lower surface of the vapor control member 2 may be spaced apart from the upper surface of the RH bulk body 2 as in the example illustrated in FIG. 3. The openings 32 of the vapor control member 3 guide the heavy rare-earth element RH that has sublimed from the upper surface of the RH bulk body 2 to the sintered magnet body 1. As a result, the heavy rare-earth element RH that has sublimed from the RH bulk body 2 is never deposited on the inner walls of the processing chamber 4 and wasted but can be selectively supplied. On top of that, since the heavy rare-earth element RH that has sublimed from the RH bulk body 2 is guided through a lot of openings 32 of the vapor control member 3 onto the surface of the sintered magnet body 1, the heavy rare-earth element RH can be supplied uniformly to both the center and peripheral portions of the sintered magnet body 1 alike.

If the thicknesses T1 and T2 of the wall portions 31 of the vapor control member 3 were too large, the surface of the sintered magnet body 1 would have some areas that are not supplied with the heavy rare-earth element RH as will be described later. For that reason, T1 and T2 are preferably 0.5 mm or less and more preferably 0.4 mm or less. Also, if the vapor control member 3 can maintain sufficient strength, the wall portions 31 have only to have thicknesses T1 and T2 of at least 0.1 mm. On the other hand, S1 and S2 are appropriately determined according to the strength of the wall portions 31. However, if the openings 32 were too small, it would be difficult to supply the heavy rare-earth element RH sublimed. That is why the area of each opening defined by S1 and S2 is preferably determined so that the ratio of the sum of the areas of the openings to the overall area of the vapor control member falls within the range of 50% to less than 100%.

Also, supposing the area of each opening is identified by A, if the ratio of the depth D of each opening 32 to its area A (which will be referred to herein as a "D/A ratio") were too large, then the probability of collision of the heavy rare-earth element RH sublimed against the inner walls of the opening 32 would increase too much to supply the heavy rare-earth element RH onto the surface of the sintered magnet body 1 smoothly. For that reason, if D and A are expressed in mm and $mm^2$, respectively, D and A are preferably designed so that the D/A ratio becomes 8 $mm^{-1}$ or less. More preferably, D and A are determined so that the D/A ratio falls within the range of 0.07 $mm^{-1}$ to 5.95 $mm^{-1}$. In that case, the mean free path of the heavy rare-earth element RH sublimed becomes much greater than the depth D of the opening 32. From the standpoints of diffusion efficiency and deformation, the depth D of the opening 32 is set to fall within the range of 1 mm to 10 mm.

In this preferred embodiment, each opening 32 of the vapor control member 3 has a cuboid shape, of which the four sides are surrounded with the wall portions 31. However, the opening 32 does not always have to have such a shape but may also have a hexagonal prism shape or any other appropriate shape. Furthermore, the openings 32 do not have to be arranged in the X and Y directions but may also be arranged so as to form a honeycomb structure.

The material of the vapor control member 3 is preferably selected from various thermally stable materials that can withstand a heat treatment at 1000° C. Specifically, the vapor control member 3 is preferably made of a ceramic with a covalent bond such as BN, a ceramic that includes, as its main ingredient, zirconia, calcia or magnesia with little oxide generating free energy, or a refractory metallic material such as Mo, Ta, W, Nb, Zr or Hf.

In the drawings, the surface of the vapor control member 3 that contacts with the sintered magnet body 1 is illustrated to be generally flat. Such a shape is preferred in order to support the flat plate sintered magnet body 1 with good stability. In addition, with such a flat surface, deformation that could be caused by using a net can be avoided.

By cutting those openings 32, the area of contact between the vapor control member 3 and the sintered magnet body 1 can be reduced. Since the rare-earth-rich phase (i.e., grain boundary phase) of the sintered magnet body 1 turns into a liquid phase at high temperatures, the sintered magnet body 1 and the vapor control member 3 would easily stick to each other where they contact with each other. And if such sticking occurred, the sintered magnet body 1 might crack, fracture or chip when released from the vapor control member 3. However, if the vapor control member 3 with a lot of openings 32 is used, such sticking rarely occurs because the area of contact can be reduced significantly.

Optionally, to avoid the problem of sticking at the contact portion, the surface of the vapor control member 3, including its portion to contact with the sintered magnet body 1, may be coated with an anti-sticking film by applying, fixing or thermally spraying a powder of a rare-earth oxide onto that surface. The anti-sticking film is preferably made of a material that hardly reacts with a rare-earth element (such as zirconia or a rare-earth oxide). Or instead of forming such an anti-sticking film, particles of an oxide that hardly reacts with a rare-earth element may be applied or scattered onto the vapor control member 3 and then the sintered magnet body 1 may be mounted on the vapor control member 3. In that case, since the surface of the vapor control member 3 is made of a material that does not react with the heavy rare-earth element RH, the heavy rare-earth element RH that has once deposited on the inner walls of the openings 32 of the vapor control member 3 will vaporize again and will eventually be supplied onto the surface of the sintered magnet body 1. As a result, the heavy rare-earth element RH, which is one of valuable natural resources, will not be wasted in vain. Optionally, the other surface of the vapor control member 3 that contacts with the RH bulk body may also be coated with an anti-sticking film.

Figure 4:
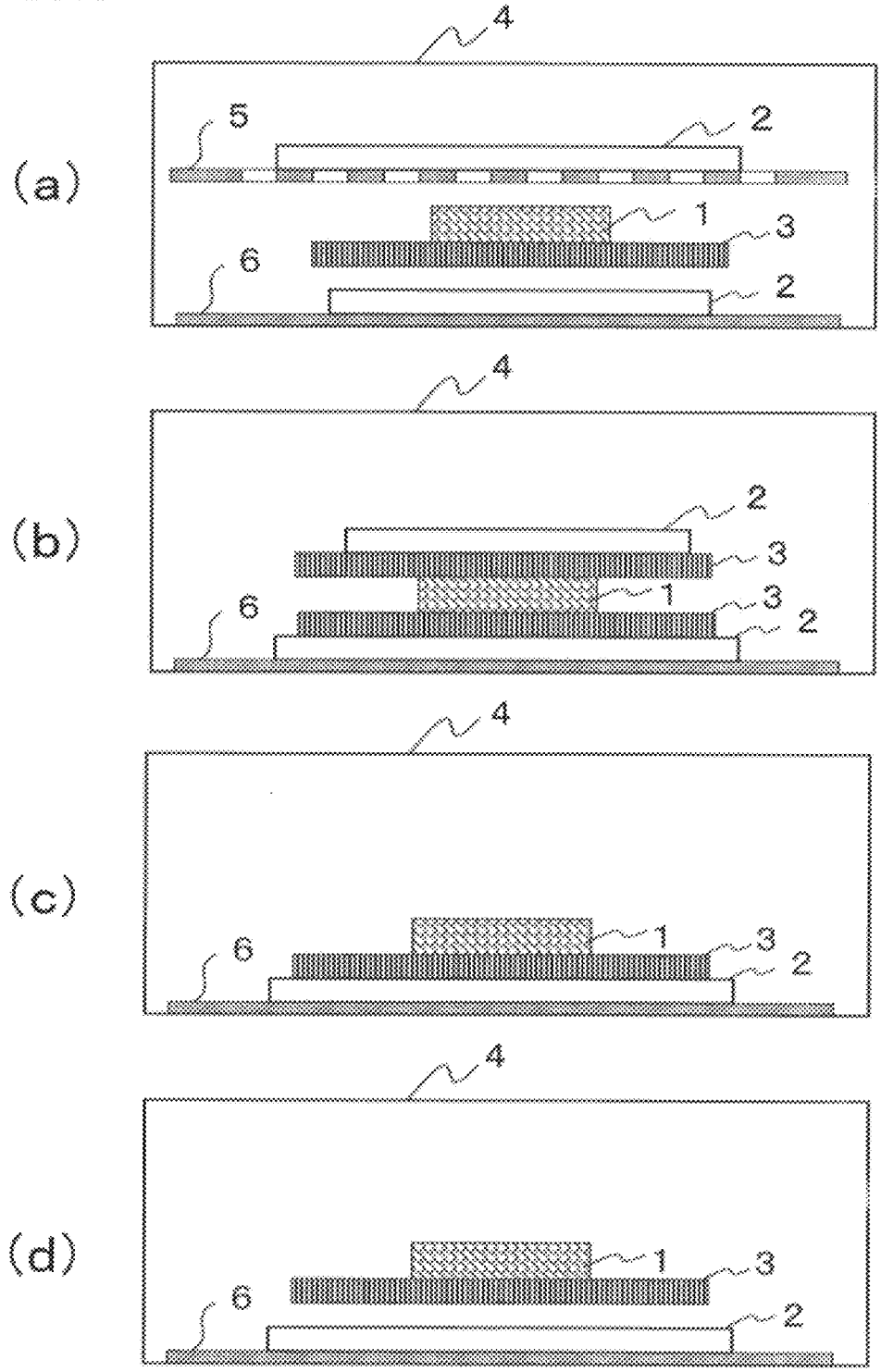
FIGS. 4(*a*) through 4(*d*) are cross-sectional views illustrating various exemplary arrangements of RH bulk bodies, sintered magnet body, and vapor control member(s).

However, the vapor control member 3 does not always have to be arranged as in the example illustrated in FIG. 1. FIGS. 4(*a*) through 4(*d*) are cross-sectional views illustrating various other arrangements.

FIG. 4(*a*) illustrates an example of an arrangement in which the vapor control member 3 is spaced apart from the RH bulk body 2 that is arranged under itself. FIG. 4(*b*) illustrates an example of an arrangement in which an additional vapor control member 3 is arranged between the sintered magnet body 1 and the upper RH bulk body 2. That is to say, in this example, one sintered magnet body 1, two RH bulk bodies 2 and two vapor control members 3 are stacked one upon the other. And FIGS. 4(*c*) and 4(*d*) illustrate examples in which the RH bulk body 2 is arranged only under the sintered magnet body 1.

It should be noted that in the exemplary arrangement shown in FIG. 1, the refractory metallic plate 5 does not contact with the sintered magnet body 1. That is why the heavy rare-earth element RH that has sublimed from the upper RH bulk body 2 can be easily supplied uniformly onto the (upper) surface of the sintered magnet body 1 through the openings 51. If that refractory metallic plate 5 were arranged in contact with the upper surface of the sintered magnet body 1, the rest of the refractory metallic plate 5, other than the openings 51, would mask the sintered magnet body 1. In that case, no heavy rare-earth element RH would be supplied onto those masked portions, which is a problem.

As can be seen from the foregoing description, if the upper RH bulk body 2 needs to be arranged either close to, or in contact with, the sintered magnet body 1, the exemplary arrangement shown in FIG. 4(*b*) is preferably adopted by replacing the refractory metallic plate 5 shown in FIG. 1 with the vapor control member 3.

In this description, the "processing chamber" broadly refers herein to any space in which the sintered magnet body 1, the RH bulk body 2 and the vapor control member 3 are arranged. Thus, the "processing chamber" sometimes means the processing chamber of a heat treatment furnace and sometimes means a processing container to be loaded into the processing chamber.

According to the present invention, with the vaporization and sublimation of the RH bulk body reduced, the heavy rare-earth element RH that has traveled through the space to reach the surface of the sintered magnet body is quickly diffused inside of the sintered magnet body as described above. That is why the temperature of the RH bulk body is preferably set to fall within the range of 700° C. to 1000° C. and the temperature of the sintered magnet body is also preferably set to fall within the range of 700° C. to 1000° C.

The gap between the sintered magnet body 1 and the vapor control member 3 is set to be 0 mm through 10 mm and the gap between the vapor control member 3 and the RH bulk body 2 is also set to be 0 mm through 10 mm. With such gap settings, the heavy rare-earth element RH vaporized can be introduced into the sintered magnet body quickly and non-wastefully. In this case, if the gap is 0 mm, then the vapor control member 3 contacts with either the sintered magnet body 1 or the RH bulk body 2. The gap between the sintered magnet body 1 and the RH bulk body 2 is set to be 20 mm or less, and is preferably 10 mm or less.

Also, according to the present invention, the heavy rare-earth element RH vaporizes little but the vapor control member 3 is arranged between the sintered magnet body 1 and the RH bulk body 2. That is why the heavy rare-earth element RH vaporized can be supplied onto the surface of the sintered magnet body 1 efficiently and is hardly deposited on the wall surfaces of the processing chamber 4.

Within the processing temperature range of the diffusion process to be carried out according to the present invention, the RH bulk body 2 never melts or softens but the heavy rare-earth element RH vaporizes (sublimes) from its surface. For that reason, the RH bulk body does not change its appearance significantly after having gone through the process step just once, and therefore, can be used repeatedly a number of times.

Besides, as the RH bulk bodies 2 and the sintered magnet body 1 can be stacked one upon the other with the vapor control member 3 interposed between them in a preferred embodiment of the present invention (see the exemplary arrangement shown in FIG. 4(*b*), for example), the number of sintered magnet bodies 1 that can be loaded into a processing chamber 4 with the same capacity can be increased. That is to say, high productivity is realized. In addition, since no bulky system is required, a normal vacuum heat treatment furnace may be used and the increase in manufacturing cost can be avoided, which is very beneficial in practical use.

During the heat treatment process, an inert atmosphere is preferably maintained inside the processing chamber. In this description, the "inert atmosphere" refers to a vacuum or an atmosphere filled with an inert gas. Also, the "inert gas" may be a rare gas such as argon (Ar) gas but may also be any other gas as long as the gas is not chemically reactive between the RH bulk body and the sintered magnet body. The pressure of the inert gas is reduced so as to be lower than the atmospheric pressure. If the pressure of the atmosphere inside the processing chamber were close to the atmospheric pressure, then the heavy rare-earth element RH would not sublime from the RH bulk body so much and would not be supplied easily onto the surface of the sintered magnet body. However, it should be enough to lower the pressure of the atmosphere inside the processing chamber to 3 Pa or less, for example. That is to say, even if the pressure of the atmosphere inside the processing chamber were further lowered, the amount of the heavy rare-earth element RH diffused inside the magnet (and eventually the degree of increase in coercivity) would not change significantly. The amount of the heavy rare-earth element RH diffused is sensitive to the processing temperature, rather than the pressure.

If the temperature of the sintered magnet body is set within the range specified above, the heavy rare-earth element RH that has traveled to reach the surface of the sintered magnet body starts to diffuse toward the inside of the magnet through the grain boundary phase without forming a deposited film there. In the meantime, a portion of the light rare-earth element RL in the $R_2Fe_{14}B$ phase is replaced with the heavy rare-earth element RH that has diffused and penetrated from the surface of the sintered magnet body. As a result, a layer including the heavy rare-earth element RH at a high concentration is formed on the outer periphery of the $R_2Fe_{14}B$ phase.

By forming such a layer including the heavy rare-earth element RH at a high concentration, the magnetocrystalline anisotropy can be improved and the coercivity $H_{cJ}$ can be increased on the outer periphery of the main phase. That is to say, even by using a small amount of heavy rare-earth element RH, the heavy rare-earth element RH can diffuse and penetrate deeper into the magnet and the layer including RH at a high concentration can be formed on the outer periphery of the main phase efficiently. As a result, the coercivity $H_{cJ}$ of the overall magnet can be increased with the decrease in remanence $B_r$ minimized.

The content of the RH to diffuse is preferably within the range of 0.05 mass % to 1.5 mass % of the overall sintered R—Fe—B based rare-earth magnet. This content range is preferred because the decrease in remanence $B_r$ could be out of control at an RH content of more than 1.5 mass % but because the increase in coercivity $H_{cJ}$ would not be significant at an RH content of less than 0.05 mass %. The process time means a period of time in which the RH bulk body and the sintered magnet body have temperatures of 700° C. to 1000° C. and pressures of $10^{-5}$ Pa to 500 Pa. Thus, during this process time, their temperatures and pressures are not always kept constant.

The surface state of the sintered magnet is as close to a metal state as possible to allow the heavy rare-earth element RH to diffuse and penetrate easily. For that purpose, the sintered magnet body is preferably subjected to an activation treatment such as acid cleaning or blast cleaning in advance. According to the present invention, however, when the heavy rare-earth element RH vaporizes and gets deposited in an active state on the surface of the sintered magnet body, the heavy rare-earth element RH will diffuse toward the inside of the sintered magnet body without forming a deposited film there. That is why the surface of the sintered magnet body may also have been oxidized to a certain degree as is observed right after a sintering process or a cutting process.

According to the present invention, the heavy rare-earth element RH can be diffused mainly through the grain boundary phase. For that reason, the heavy rare-earth element RH can be diffused deeper into the magnet more efficiently by controlling the process time.

The shape and size of the RH bulk bodies are not particularly limited. But it is preferred that the RH bulk bodies have a plate shape. Optionally, the RH bulk bodies may have a lot of very small holes with diameters of several ten μm. Oxides, fluorides and nitrides including the heavy rare-earth element RH that is at least one element selected from the group consisting of Dy, Ho and Tb have so low vapor pressures that evaporation diffusion hardly occurs under the conditions falling within these ranges of temperatures and degrees of vacuum. For that reason, even if the RH bulk bodies are made of an oxide, a fluoride or a nitride including the heavy rare-earth element RH, the coercivity cannot be increased effectively.

According to the present invention, the heavy rare-earth element RH may diffuse and penetrate either from both of the upper and lower surfaces of the sintered magnet body or from just one of those two surfaces of the sintered magnet body.

If the openings are cut through only a particular area of the vapor control member, not through the entire surface thereof, then the heavy rare-earth element RH can diffuse and penetrate through that particular portion of the surface of the sintered magnet body. By modifying the structure of the vapor control member, a magnet, of which the coercivity $H_{cJ}$ has been increased partially, can be obtained without covering a portion of the sintered magnet body, where the heavy rare-earth element RH should not diffuse and penetrate, with a special masking layer.

If the magnet that has gone through the evaporation diffusion process of the present invention is further subjected to a heat treatment process, the coercivity $H_{cJ}$ can be further increased. As for the processing temperature and the process time of the heat treatment process, the magnet is preferably maintained at a temperature of 700° C. to 1000° C. for 10 to 600 minutes.

The heat treatment process may be carried out just by thermally treating the magnet with the partial pressure of Ar increased to about $10^3$ Pa after the diffusion process such that the heavy rare-earth element RH does not vaporize. Alternatively, after the diffusion process has been finished once, only the heat treatment may be carried out under the same conditions as the diffusion process without putting the RH bulk body.

By subjecting the sintered magnet body to the heavy rare-earth element RH diffusion process, the transverse rupture strength and other mechanical strength of the sintered R—Fe—B based rare-earth magnet can be increased, which is beneficial in practical use. This is presumably because the degree of matching between the crystal grains of the main phase and those of the grain boundary phase has increased as a result of the removal of the internal strain from the sintered magnet body, the repair of damage on the machined layer, or the diffusion of the heavy rare-earth element RH during the diffusion process. If the degree of matching increases between the crystal grains of the main phase and those of the grain boundary phase, the grain boundary can be consolidated and the resistance to rupture of the grain boundary can be increased.

Hereinafter, a preferred embodiment of a method for producing a sintered R—Fe—B based rare-earth magnet according to the present invention will be described.

EMBODIMENTS

Material Alloy

First, an alloy including 25 mass % to 40 mass % of a light rare-earth element RL, 0.6 mass % to 1.6 mass % of B (boron) and Fe and inevitably contained impurities as the balance is provided. A portion of B may be replaced with C (carbon) and a portion (50 at % or less) of Fe may be replaced with another transition metal element such as Co or Ni. For various purposes, this alloy may contain about 0.01 mass % to about 1.0 mass % of at least one additive element M that is selected from the group consisting of Al, Si, Ti, V, Cr, Mn, Ni, Cu, Zn, Ga, Zr, Nb, Mo, Ag, In, Sn, Hf, Ta, W, Pb and Bi. The alloy may also include a heavy rare-earth element RH.

Such an alloy is preferably made by quenching a melt of a material alloy by strip casting process, for example. Hereinafter, a method of making a rapidly solidified alloy by strip casting process will be described.

First, a material alloy with the composition described above is melted by an induction heating process within an argon atmosphere to make a melt of the material alloy. Next, this melt is kept heated at about 1350° C. and then quenched by single roller process, thereby obtaining a flake-like alloy block with a thickness of about 0.3 mm. Then, the alloy block thus obtained is pulverized into flakes with a size of 1 mm to 10 mm before being subjected to the next hydrogen pulverization process. Such a method of making a material alloy by strip casting process is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually improve the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically 3 μm to 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, 0.3 wt % of lubricant is added to, and mixed with, the magnetic powder, obtained by the method described above, in a rocking mixer, thereby coating the surface of the alloy powder particles with the lubricant. Next, the magnetic powder prepared by the method described above is compacted under an aligning magnetic field using a known press machine. The aligning magnetic field to be applied may have a strength of 0.8 to 1.2 MA/m, for example. Also, the compacting pressure is set so that the green compact has a green density of about 4 g/cm$^3$ to about 4.5 g/cm$^3$.

Sintering Process

The powder compact described above is preferably sequentially subjected to the process of maintaining the compact at a temperature of 650° C. to 1000° C. for 10 to 240 minutes and then to the process of further sintering the compact at a higher temperature (of 1000° C. to 1200° C., for example) than in the maintaining process. Particularly when a liquid phase is produced during the sintering process (i.e., when the temperature is in the range of 650° C. to 1000° C.), the R-rich phase on the grain boundary phase starts to melt to produce the liquid phase. Thereafter, the sintering process advances to form a sintered magnet body eventually. The sintered magnet body can also be subjected to the heavy rare-earth element RH diffusion process even if its surface has been oxidized as described above. For that reason, the sintered magnet body may be subjected to an aging treatment (at a temperature of 400° C. to 700° C.) or machined to adjust its size.

Heavy Rare-Earth Element RH Diffusion Process

Next, the heavy rare-earth element RH is made to diffuse and penetrate efficiently into the sintered magnet body thus obtained, thereby increasing the coercivity $H_{cJ}$ thereof. More specifically, a sintered magnet body 1, an RH bulk body 2 including the heavy rare-earth element RH, and a vapor control member 3 are put into the processing chamber 4 shown in FIG. 1 and then heated, thereby diffusing the heavy rare-earth element RH inside the sintered magnet body 1 while supplying the heavy rare-earth element RH from the RH bulk body 2 onto the surface of the sintered magnet body 1 via the vapor control member 3.

In the diffusion process of this preferred embodiment, the temperature of the sintered magnet body 1 is preferably set to be equal to that of the bulk body. In this description, when the temperature of the sintered magnet body 1 is equal to that of the RH bulk body 2, it means that the difference in temperature between the sintered magnet body 1 and the RH bulk body 2 is within 20° C. Specifically, the temperatures of the RH bulk body 2 and the sintered magnet body 1 preferably both fall within the range of 700° C. to 1000° C. Also, the gap between the sintered magnet body 1 and the vapor control member 3 is set to be within the range of 0 mm to 10 mm. The gap between the vapor control member 3 and the RH bulk body 2 is set to be within the range of 0 mm to 10 mm. And the gap between the sintered magnet body 1 and the RH bulk body 2 is set to be 20 mm or less.

Also, the pressure of the atmospheric gas during the diffusion process preferably falls within the range of $10^{-5}$ Pa to 500 Pa. Then, the heavy rare-earth element RH can be supplied onto the surface of the sintered magnet body smoothly with the vaporization (sublimation) of the RH bulk body advanced appropriately. To avoid an excessive sublimation or a waste of the RH bulk body, it is preferred that the pressure of the atmospheric gas be set within the range of $10^{-3}$ Pa to 1 Pa. Furthermore, the amount of time for maintaining the temperatures of the RH bulk body and the sintered magnet body within the range of 700° C. to 1000° C. is preferably 10 to 600 minutes. It should be noted that the "time for maintaining the temperatures" refers to a period in which the RH bulk body and the sintered magnet body have temperatures varying within the range of 700° C. to 1000° C. and pressures varying within the range of $10^{-5}$ Pa to 500 Pa and does not necessarily refer to a period in which the RH bulk body and sintered magnet body have their temperatures and pressures fixed at a particular temperature and a particular pressure.

The RH bulk body 2 may include an alloy of a heavy rare-earth element RH and an element X, which is at least one element selected from the group consisting of Nd, Pr, La, Ce, Al, Zn, Sn, Cu, Co, Fe, Ag and In. Such an element X would lower the melting point of the grain boundary phase and would hopefully promote the grain boundary diffusion of the heavy rare-earth element RH. By thermally treating, in a vacuum, the bulk body 2 of such an alloy and the sintered magnet body that are spaced from each other, the heavy rare-earth element RH and the element X can be not only evaporated and deposited on the surface of the sintered magnet body but also diffused inside the sintered magnet body through the grain boundary phase (Nd-rich phase) that has turned into a liquid phase preferentially.

Optionally, after the diffusion process is over, the heat treatment process described above may be carried out at a temperature of 700° C. to 1000° C. If necessary, an aging treatment is also carried out at a temperature of 400° C. to 700° C. If the heat treatment at a temperature of 700° C. to 1000° C. is carried out, the aging treatment is preferably performed after the heat treatment has ended. The heat treatment and the aging treatment may be conducted in the same processing chamber.

In practice, the sintered R—Fe—B based rare-earth magnet that has been subjected to the diffusion process is preferably subjected to some surface treatment, which may be a known one such as Al evaporation, electrical Ni plating or resin coating. Before the surface treatment, the sintered magnet body may also be subjected to a known pre-treatment such as sandblast abrasion process, barrel abrasion process, etching process or mechanical grinding. Optionally, after the diffusion process, the sintered magnet body may be ground to have its size adjusted. Even after having gone through any of these processes, the coercivity can also be increased almost as effectively as always. For the purpose of size adjustment, the sintered magnet body is preferably ground to a depth of 1 μm to 300 μm, more preferably to a depth of 5 μm to 100 μm, and even more preferably to a depth of 10 μm to 30 μm.

EXAMPLES

Example 1

An alloy was prepared by strip casting process so as to have a composition consisting of 23.3 mass % of Nd, 6.0 mass % of Pr, 2.5 mass % of Dy, 0.99 mass % of B, 0.92 mass % of Co, 0.1 mass % of Cu, 0.24 mass % of Al and Fe as the balance, thereby making thin alloy flakes with thicknesses of 0.2 mm to 0.3 mm.

Next, a container was loaded with those thin alloy flakes and then introduced into a hydrogen pulverizer, which was filled with a hydrogen gas atmosphere at a pressure of 500 kPa. In this manner, hydrogen was occluded into the thin alloy flakes at room temperature and then partially released by heating the alloy flakes to 500° C. in a vacuum. By performing such a hydrogen process, the thin alloy flakes were decrepitated to obtain a powder with sizes of about 0.15 mm to about 0.5 mm.

Thereafter, 0.05 wt % of zinc stearate was added as a pulverization aid to the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1020° C. for four hours in a vacuum furnace, thus obtaining sintered blocks, which were then machined and cut into sintered magnet bodies with a thickness of 3 mm, a length of 25 mm and a width of 50 mm.

These sintered magnet bodies were acid-cleaned with a 0.3% nitric acid aqueous solution, dried, and then arranged in a processing chamber with the configuration shown in FIG. 1. In this example, the following three kinds of vapor control members were used:

1) a member having a wall portion thickness of 1.1 mm and openings with dimensions of 5.3 mm×5.3 mm, composed mainly of calcium aluminate ($CaO.2Al_2O_3.SiO_2$, $TiO_2$), and having a height (depth) of 3 mm×a length of 100 mm×a width of 100 mm;
2) a member having a wall portion thickness of 0.45 mm and openings with dimensions of 1.4 mm×1.4 mm, composed mainly of calcium aluminate ($CaO.2Al_2O_3.SiO_2$, $TiO_2$), and having a height (depth) of 3 mm×a length of 100 mm×a width of 100 mm; and
3) a member having a wall portion thickness of 0.3 mm and openings with dimensions of 1.4 mm×1.4 mm, composed mainly of cordierite ($2MgO.2Al_2O_3.5SiO_2$), and having a height (depth) of 10 mm×a length of 150 mm×a width of 150 mm.

The RH bulk body was made of Dy with a purity of 99.9% and dimensions of 50 mm×50 mm×5 mm. In this case, the gap between the sintered magnet body and the vapor control member was set to be 0 mm and the gap between the vapor control member and the RH bulk body was set to be 10 mm. Next, using those three kinds of vapor control members, the processing chamber shown in FIG. 1 is loaded into a vacuum heat treatment furnace, thereby performing a heavy rare-earth element RH diffusion process. Specifically, the processing chamber was heated with a heater (not shown in FIG. 1), thereby adjusting the temperature in the processing chamber to 900° C. and keeping the temperature for 1.5 hours. In the following description, the heat treatment temperature means the temperature of the sintered magnet body and that of the RH bulk body (that is almost equal to the former temperature) unless stated otherwise. In this specific example, no sticking occurred at all between the sintered magnet body and the vapor control member and the sintered magnet body could be released from the vapor control member smoothly without getting damaged at all.

After the diffusion process was carried out, an aging treatment was performed at a pressure of 2 Pa and at a temperature of 500° C. for 60 minutes.

Figure 5:
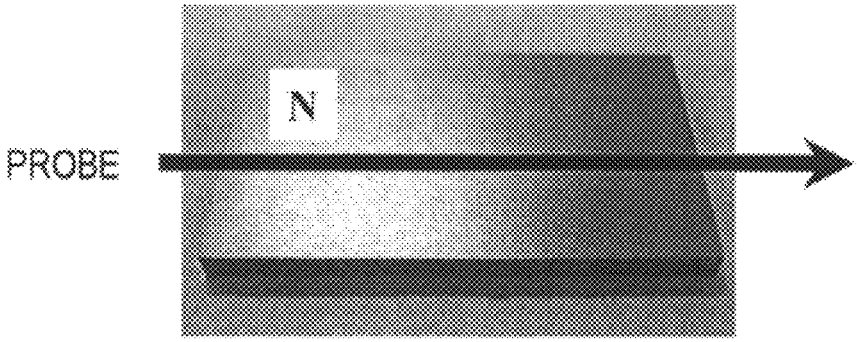
FIG. 5(*a*) indicates an area to be scanned with a measuring probe, FIG. 5(*b*) is a graph showing surface flux densities Bg that were measured on N and S surfaces, and FIG. 5(*c*) is a graph showing those surface flux densities Bg in a different form.
Figure 5:
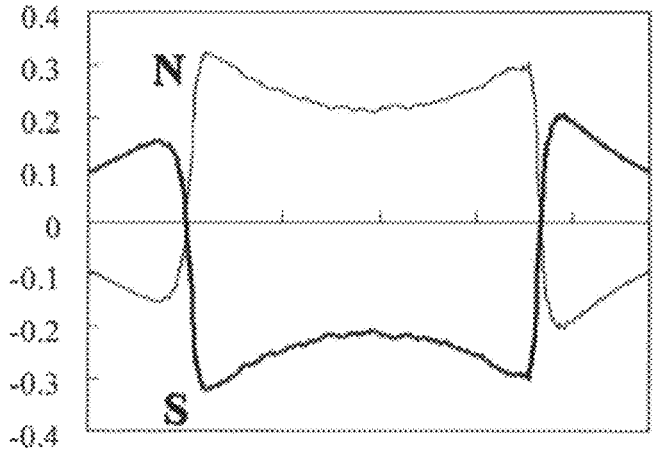
Figure 5:
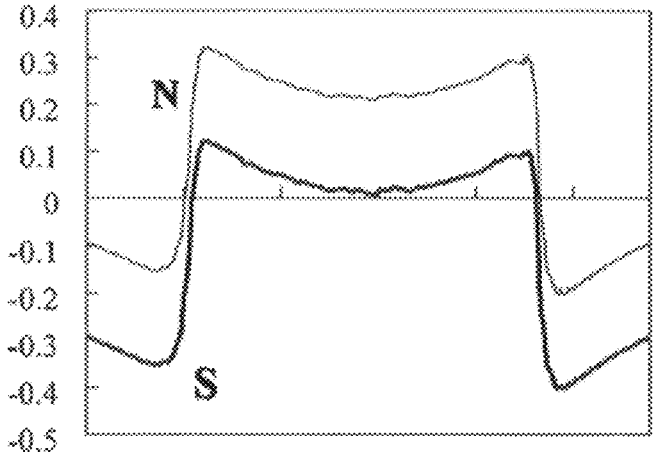

Samples of sintered R—Fe—B based rare-earth magnets that had been subjected to the diffusion process using the three different kinds of vapor control members 1), 2) and 3), respectively, were magnetized with pulses with a strength of 3 MA/m, heated to 120° C. for two hours for evaluation purposes, and then cooled to an ordinary temperature. Since the RH element would not diffuse sufficiently as a result of such a heating process, demagnetization would be produced in a portion with a low $H_{cJ}$. After that, the surface flux densities of those samples of measurement thus obtained were measured with a gauss meter. By being heated to 120° C. for two hours, such a portion with a low $H_{cJ}$ was demagnetized and came to have a decreased magnetic flux density. As shown in FIG. 5(*a*), the surface flux density was measured by scanning linearly a center portion on the surface (N pole) of the sintered R—Fe—B based rare-earth magnet with a measuring probe of the gauss meter. Meanwhile, the surface flux density was also measured in the same way by scanning linearly a center portion on the back surface (S pole) of the sintered R—Fe—B based rare-earth magnet with the measuring probe of the gauss meter. FIG. 5(*b*) shows both of the surface flux densities on the N- and S-surfaces. On the other hand, FIG. 5(*c*) is a graph showing an inverted and downwardly shifted surface flux density on the S-surface shown in FIG. 5(*b*).

Figure 6:
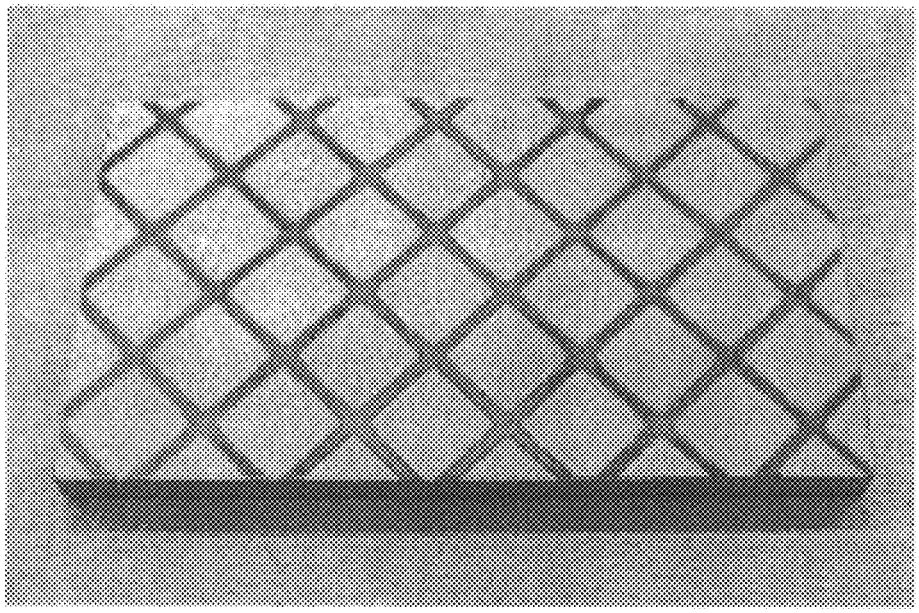
FIG. 6 is a photograph showing the surface of a sintered magnet body that was subjected to an evaporation diffusion process using a vapor control member with a wall portion thickness of 1.1 mm.

FIG. 6 is a photograph showing a sample that was subjected to an evaporation diffusion process using the vapor control member 1) described above. As can be seen easily from FIG. 6, a grating pattern was observed on the surface of the sintered body. This grating pattern corresponds to the area where the supply of the heavy rare-earth element RH was interfered with by the wall portions of the vapor control member. To confirm the effects achieved by the present invention, the sample was heated, cooled and then had its surface flux density Bg measured. As a result, the surface flux density Bg decreased particularly significantly at the area with that grating pattern.

Figure 7:
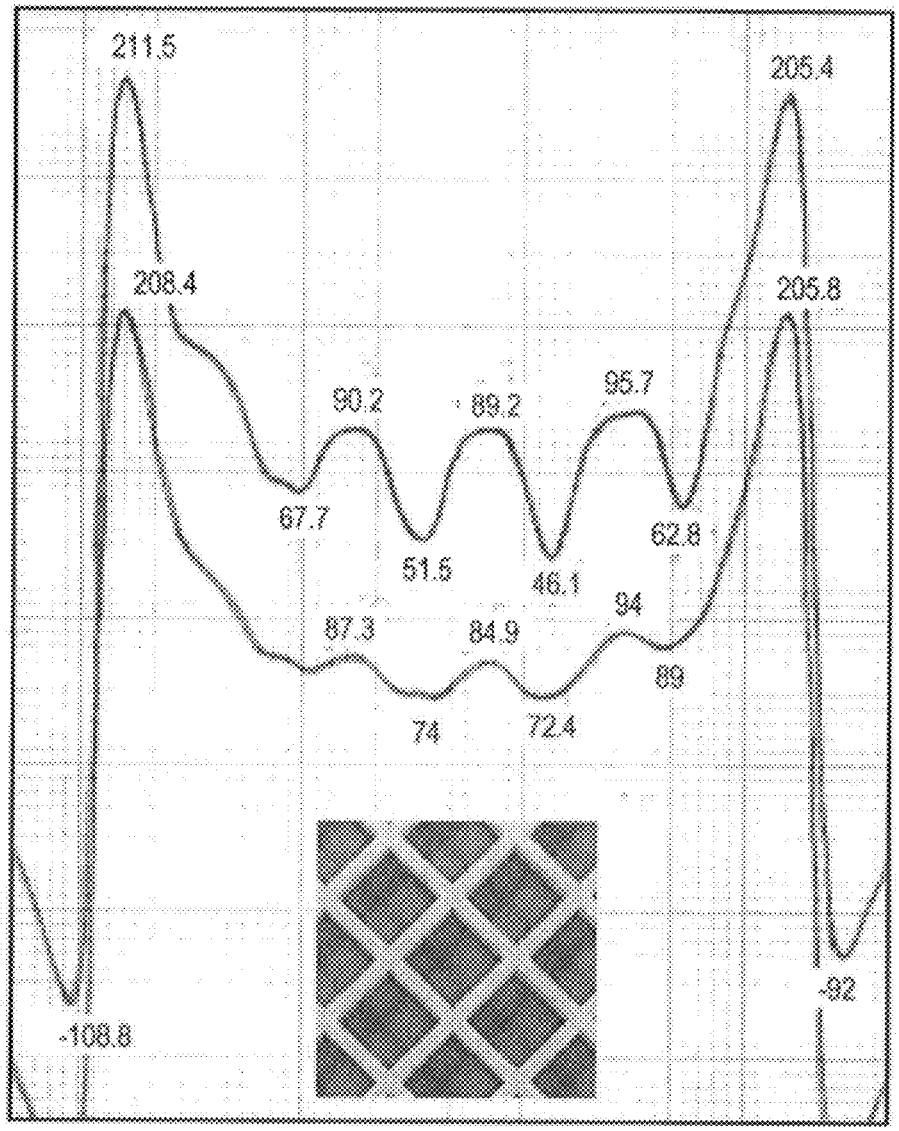
FIG. 7 is a graph showing the surface flux density Bg of the magnet that was measured after the magnet had been heated and cooled to confirm the effects of the present invention.
Figure 8:
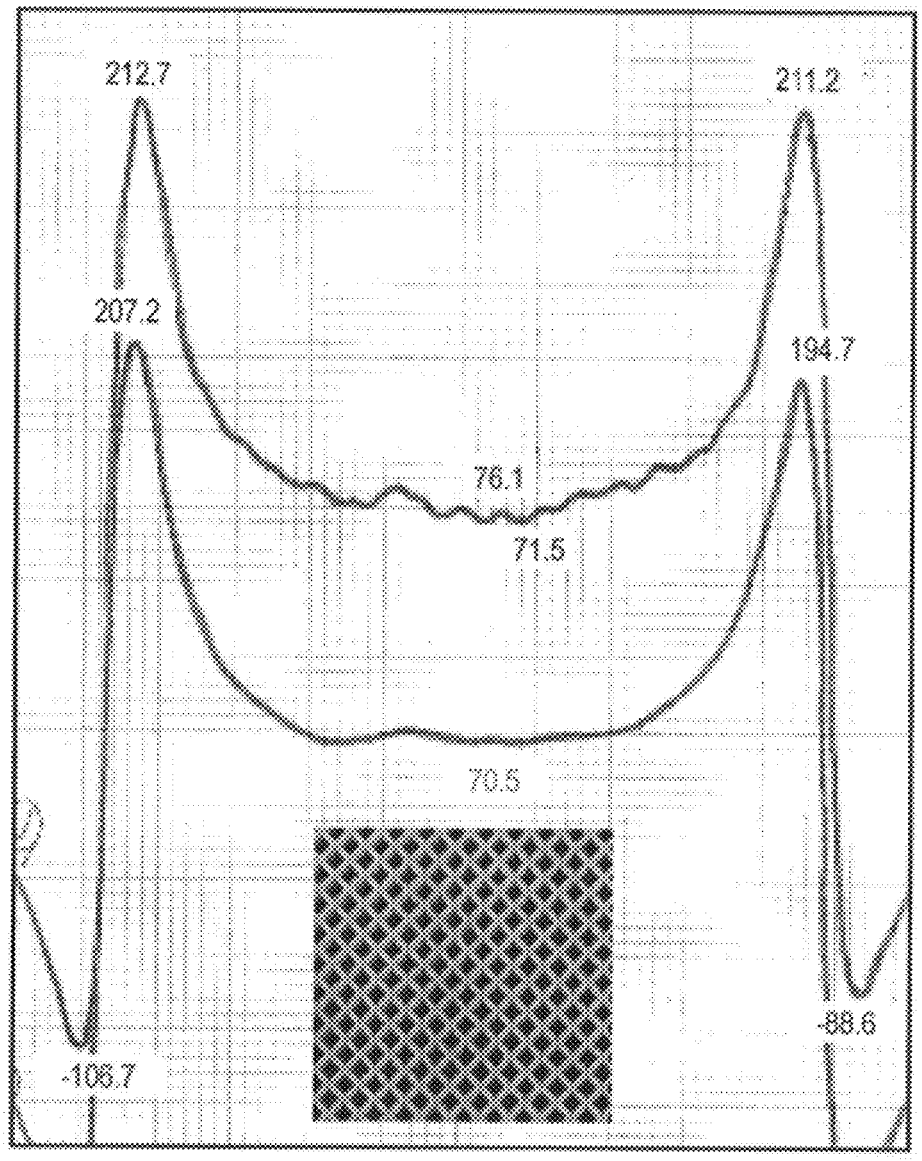
FIG. 8 is a graph showing how the surface flux density Bg of a sample, in which a heavy rare-earth element RH was diffused using a vapor control member with a wall portion thickness of 0.45 mm, varied after a thermal demagnetization process.
Figure 9:
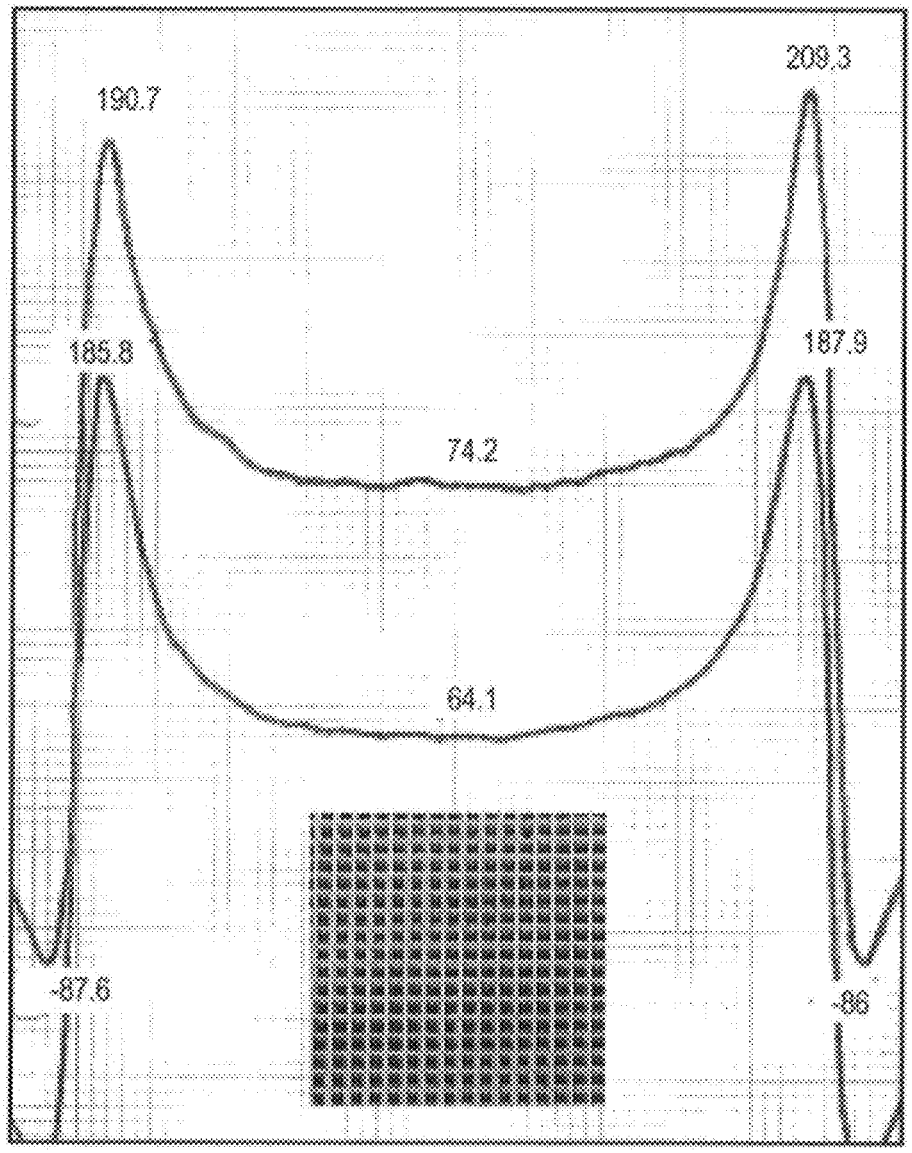
FIG. 9 is a graph showing how the surface flux density Bg of a sample, in which a heavy rare-earth element RH was diffused using a vapor control member with a wall portion thickness of 0.3 mm, varied after the heating and cooling process.

FIGS. 7, 8 and 9 are graphs showing the surface flux densities Bg of respective samples that had been subjected to an evaporation diffusion process using the three different kinds of vapor control members described above. Specifically, the results of measurement shown in FIG. 7 were obtained from a sample of a sintered R—Fe—B based rare-earth magnet that had been subjected to the diffusion process using the vapor control member 1) described above. The results of measurement shown in FIG. 8 were obtained from a sample of a sintered R—Fe—B based rare-earth magnet that had been subjected to the diffusion process using the vapor control member 2) described above. And the results of measurement shown in FIG. 9 were obtained from a sample of a sintered R—Fe—B based rare-earth magnet that had been subjected to the diffusion process using the vapor control member 3) described above. FIGS. 7, 8 and 9 show how the surface flux density Bg varied when the center portion on the surface of the sintered R—Fe—B based rare-earth magnet (which was either N pole or S pole) was measured with a gauss meter as shown in FIGS. 5(*a*) to 5(*c*). In FIGS. 7, 8 and 9, the upper Bg waveform was obtained on the N-pole side and the lower Bg waveform was obtained on the S-pole side. Also, in FIGS. 7 to 9, the ordinate represents Bg (mT). That is to say, in each of FIGS. 7 to 9, a Bg value at the peak of the Bg waveform is shown in mT. On the other hand, the abscissa represents the magnitude of shift (mm) when the measurement was done with a gauss meter as shown in FIG. 5(*a*). The distance between two peaks of Bg corresponds to the width of the sintered R—Fe—B based rare-earth magnet.

In each of these graphs, a locally depressed portion of each curve represents a portion where demagnetization was produced more significantly as a result of the heat treatment than other portions. That portion corresponds to a surface area of the sintered R—Fe—B based rare-earth magnet where a smaller amount of heavy rare-earth element RH was supplied or diffused than other areas and which will be referred to herein as an "insufficiently diffused area".

As can be seen easily by comparing FIGS. 7, 8 and 9 to each other, when a vapor control member with a wall portion thickness of 1.1 mm was used, the surface flux density Bg varied more significantly from one location to another than in a situation where a vapor control member with a greater wall portion thickness was used. However, if the wall portion thickness was 0.5 mm or less, the surface flux density Bg varied more gently from one location to another. This means that if the wall portions of the vapor control member had a thickness of more than 0.5 mm, the wall portions would interfere with the supply of the heavy rare-earth element RH but that if the wall portions had a thickness of 0.5 mm or less, the wall portions would hardly interfere with the supply of the heavy rare-earth element RH. It can also be seen that if the wall portions of the vapor control member had a thickness of 0.4 mm or less, no areas with significant thermal demagnetization were observed anymore and the heavy rare-earth element RH was uniformly supplied onto, and diffused through, the surface of the sintered magnet body.

The remanence $B_r$ and intrinsic coercivity $H_{cJ}$ of each of those samples were measured. As a result, each sample had a remanence $B_r$ of 1.33 T and an intrinsic coercivity $H_{cJ}$ of 1650 to 1700 kA/M.

Example 2

Next, the influence of the D/A ratio (where A represents the area of each opening 32 and D represents the depth of the opening 32) on magnetic properties will be described. The following Table 1 shows specific example of the present invention and comparative examples, of which the vapor control members were made of mutually different materials and had respectively different shape parameters such as the thicknesses T1 and T2. In each of these specific examples of the present invention and comparative examples, its sintered magnet body was made and subjected to the diffusion process under the same conditions as in Example 1 described above, except that the vapor control member was modified as shown in the following Table 1:

TABLE 1

| No | | Material of vapor control member | Thickness T1 (mm) | Thickness T2 (mm) | Depth D (mm) | Area A ($mm^2$) | D/A ($mm^{-1}$) | Local decrease in surface flux density* | heavy rare-earth element RH introduction efficiency (%)** | Deformed? *** |
|---|---|---|---|---|---|---|---|---|---|---|
| 1 | Example | cordierite | 0.5 | 0.5 | 5 | 1.96 | 2.55 | ○ | ○ | ○ |
| 2 | Example | (2MgO• | 0.5 | 0.5 | 10 | 1.96 | 5.10 | ○ | ○ | ○ |
| 3 | Comparative Example | $2Al_2O_3$• $5SiO_2$) | 0.5 | 0.5 | 20 | 1.96 | 10.20 | ○ | X | ○ |
| 4 | Comparative Example | | 0.5 | 0.5 | 0.05 | 1.96 | 0.03 | Could not be produced | | |
| 5 | Example | | 0.3 | 0.3 | 3 | 1.44 | 2.08 | ◎ | ○ | ○ |
| 6 | Example | | 0.3 | 0.5 | 10 | 1.68 | 5.95 | ◎ | ○ | ○ |
| 7 | Comparative Example | | 0.3 | 0.5 | 18 | 1.68 | 10.71 | ◎ | X | ○ |
| 8 | Comparative Example | | 0.8 | 0.8 | 7 | 9 | 0.78 | X | ○ | ○ |
| 9 | Comparative Example | | 1.0 | 1.5 | 10 | 30 | 0.33 | X | ○ | ○ |
| 10 | Comparative Example | | 2.2 | 2.2 | 12 | 56.25 | 0.21 | X | ◎ | ○ |
| 11 | Example | calcium | 0.45 | 0.45 | 6 | 1.96 | 3.06 | ○ | ○ | ○ |
| 12 | Example | aluminate | 0.45 | 0.45 | 9 | 1.96 | 4.59 | ○ | ○ | ○ |
| 13 | Comparative Example | (CaO• $2Al_2O_3$• | 0.7 | 0.7 | 10 | 7.84 | 1.28 | X | ○ | ○ |
| 14 | Comparative Example | $SiO_2$, $TiO_2$) | 0.7 | 0.7 | 20 | 7.84 | 2.55 | X | X | ○ |
| 15 | Example | Grating | 0.3 | 0.3 | 7 | 100 | 0.07 | ◎ | ◎ | ○ |
| 16 | Example | shaped | 0.5 | 0.5 | 7 | 100 | 0.07 | ○ | ◎ | ○ |

TABLE 1-continued

| No | | Material of vapor control member | Thickness T1 (mm) | Thickness T2 (mm) | Depth D (mm) | Area A ($mm^2$) | D/A ($mm^{-1}$) | Local decrease in surface flux density* | heavy rare-earth element RH introduction efficiency (%)** | Deformed? *** |
|---|---|---|---|---|---|---|---|---|---|---|
| 17 | Example | frame plate (Mo) | 0.5 | 0.5 | 10 | 100 | 0.10 | ○ | ○ | ○ |
| 18 | Comparative Example | | 0.5 | 0.5 | 0.08 | 100 | 0.00 | X | ◎ | X |
| 18 | Comparative Example | | 1.0 | 1.0 | 3 | 100 | 0.03 | X | ◎ | ○ |
| 18 | Comparative Example | | 1.5 | 1.5 | 5 | 100 | 0.05 | X | ◎ | ○ |
| 19 | Comparative Example | Net of Nb with ϕ of 0.3 mm | — | — | — | — | — | ○ | ◎ | X |
| 20 | Comparative Example | Net of Nb with ϕ of 1.0 mm | — | — | — | — | — | X | ◎ | X |

*◎ indicates the local decrease was less than 5%, ○ indicates the local decrease was less then 10%, and X indicates the local decrease was 10% or more,
**◎ indicates the efficiency was 80% or more, ○ indicates the efficiency was 60% or more, and X indicates the efficiency was less than 60%, and
***○ indicates the member was not deformed and X indicates the member was deformed.

In Table 1, the magnitude of local decrease in surface flux density is obtained by measuring the surface flux densities at the center portion of a sintered R—Fe—B based rare-earth magnet and at a demagnetized portion that surrounds the center portion by the method shown in FIG. 5(*a*) and then making the calculation given by the following Equation (1):

((surface flux density at center portion of sintered R—Fe—B based rare-earth magnet)(average surface flux density at surrounding demagnetized portion))/(surface flux density at center portion of sintered R—Fe—B based rare-earth magnet)×100 (1)

In Table 1, ◎ indicates that the magnitude of local decrease in surface flux density was less than 5%, ○ indicates that the magnitude of local decrease in surface flux density was less than 10%, and x indicates that the magnitude of local decrease in surface flux density was 10% or more.

Also, the "heavy rare-earth element RH introduction efficiency" shown in Table 1 is calculated by the following Equation (2):

(mass introduced from RH bulk body into sintered magnet body)/(decreased mass of RH bulk body after diffusion process)×100 (2)

In Table 1, ◎ indicates that the heavy rare-earth element RH introduction efficiency was 80% or more, indicates that the heavy rare-earth element RH introduction efficiency was 60% or more, and x indicates that the heavy rare-earth element RH introduction efficiency was less than 60%.

And the "deformation" shown in Table 1 indicates whether or not the vapor control member caused any visually sensible deformation after the diffusion process. In Table 1, ○ indicates that no deformation such as surface warp or twist was seen in the vapor control member and x indicates that some deformation was observed in the vapor control member.

As can be seen from Table 1, in Samples #1, #2, #5, #6, #11, #12, #15, #16 and #17 representing specific examples of the present invention, there was little local decrease in surface flux density, the RH element could be introduced into the sintered magnet body efficiently enough, and the member was hardly deformed.

INDUSTRIAL APPLICABILITY

According to a method for producing a sintered R—Fe—B based rare-earth magnet of the present invention, a small amount of heavy rare-earth element RH can be used efficiently and can be diffused uniformly over the entire surface of the magnet body.

A vapor control member for use in the present invention can introduce a heavy rare-earth element RH, which is at least one of Dy, Ho and Tb, through the surface of the magnet efficiently and effectively. And the vapor control member has good thermal resistance, is hardly deformable, and can be used repeatedly a number of times, thus contributing to cutting down the manufacturing cost and increasing the production yield. On top of that, since the vapor control member hardly sticks to the sintered magnet body, the sintered magnet body never partially chips or collapses even when the sintered magnet body that has been subjected to the RH diffusion process is released from the vapor control member.

REFERENCE SIGNS LIST

1 sintered R—Fe—B based rare-earth magnet body
2 RH bulk body
3 vapor control member
4 processing chamber (processing container)
5 refractory metallic plate
6 refractory metallic tray

The invention claimed is:

1. A method for producing a sintered R—Fe—B based rare-earth magnet, the method comprising the steps of:

providing a sintered R—Fe—B based rare-earth magnet body including, as a main phase, crystal grains of an $R_2Fe_{14}B$ type compound that includes a light rare-earth element RL, which is at least one of Nd and Pr, as a major rare-earth element R;

providing a bulk body including a heavy rare-earth element RH, which is at least one element selected from the group consisting of Dy, Ho and Tb;

arranging the sintered R—Fe—B based rare-earth magnet body and the bulk body in a processing chamber with a vapor control member interposed between the sintered R—Fe—B based rare-earth magnet body and the bulk body; and heating the inside of the processing chamber to a temperature of 700° C. to 1000° C., thereby diffusing the heavy rare-earth element RH into the sintered R—Fe—B based rare-earth magnet body while supplying the heavy rare-earth element RH from the bulk body to the surface of the sintered R—Fe—B based rare-earth magnet body via the vapor control member, wherein the vapor control member includes:

an upper surface and a lower surface;

a plurality of openings, which communicate between the upper and lower surfaces; and a wall portion, which defines the openings, and wherein the wall portion has a thickness of 0.5 mm or less, each said opening of the vapor control member has a depth of 1 mm to 10 mm, D/A is equal to or smaller than 8 $mm^{-1}$, where each said opening of the vapor control member has an area of A [$mm^2$] and a depth of D [mm], and in the step of heating, a gap between the sintered R—Fe—B based rare-earth magnet body and the vapor control member is set to be within a range of 0 mm to 10 mm, a gap between the vapor control member and the bulk body is set to be within a range of 0 mm to 10 mm, and a gap between the sintered R—Fe—B based rare-earth magnet body and the bulk body is set to be 10 mm or less.

2. The method of claim 1, comprising the step of supporting the sintered R—Fe—B based rare-earth magnet body on the upper surface of the vapor control member and supplying the heavy rare-earth element RH from the bulk body, which is arranged to face the lower surface of the vapor control member, to the surface of sintered R—Fe—B based rare-earth magnet body.

3. The method of claim 1, wherein a portion of the vapor control member that contacts with the sintered R—Fe—B based rare-earth magnet body is coated with an anti-sticking film.

4. The method of claim 1, wherein the vapor control member is made of a ceramic material.

5. The method of claim 1, wherein the vapor control member has a flat end facet on the upper and lower surfaces.

6. The method of claim 1, wherein each of the openings of the vapor control member is defined as a cuboid space, of which four faces are surrounded with the wall portion.

7. The method of claim 1, wherein the openings of the vapor control member are arranged so as to form a honeycomb structure.

8. The method of claim 1, wherein each of the gaps has a fixed value during the heating step.

* * * * *